United States Patent [19]

Hudson, Jr. et al.

[11] 4,068,912

[45] Jan. 17, 1978

[54] CABLE CLAMPING INSULATION DISPLACING ELECTRICAL CONNECTOR FOR MULTI-CONDUCTOR FLAT FLEXIBLE CABLE

[75] Inventors: William Jeffrey Hudson, Jr., Hershey; Johannes Cornelis Wilhelmus Bahermans, Harrisburg, both of Pa.

[73] Assignee: AMP Incorporated, Harrisburg, Pa.

[21] Appl. No.: 772,172

[22] Filed: Feb. 25, 1977

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS 3,816,818 6/1974 Meier ..... 339/99 R 3,820,055 6/1974 Huffnagle et al. ..... 339/97 P

FOREIGN PATENT DOCUMENTS 2,253,290 6/1975 France ..... 339/98

*Primary Examiner*—Joseph H. McGlynn

*Attorney, Agent, or Firm*—Russell J. Egan

[57] ABSTRACT

A method and apparatus for terminating multi-conductor flat flexible cable is disclosed. The connector assembly includes a clamp member which initially engages a multi-conductor flat cable and drives the conductors thereof to the desired spacing, which conforms to the fixed spacing of the terminals in a connector housing member. The clamped cable is then engaged with the terminal carrying housing member of the connector assembly to effect an insulation displacing engagement of the terminal with their respective conductors.

7 Claims, 3 Drawing Figures

CABLE CLAMPING INSULATION DISPLACING ELECTRICAL CONNECTOR FOR MULTI-CONDUCTOR FLAT FLEXIBLE CABLE

BACKGROUND OF THE INVENTION

1. The Field of the Invention

The present invention relates to the termination of multi-conductor flat flexible cable and in particular to a method and apparatus for assuring proper spacing of the conductors of the cable at the point of engagement with the respective terminals of the connector.

2. The Prior Art

The most relevant prior art is shown in U.S. Pat. No. 3,820,055, which is assigned to the present assignee, and represents a product well known in the electrical connector industry as the AMPLATCH connector. While this product has achieved substantial success in the industry, there has always been a limited degree of difficulty in employing the product due to the inaccurate spacing of conductors in most of the commercially available cables. When the product is to be terminated with a cable on the 0.050 inch centers, the terminals can be accurately located in the molded cavities of the housings of the connector. However, the conductors of the cable frequently wander several thousands of an inch from their correct center line and thus could be in positions where they would be severed by the arms of the terminal or perhaps would altogether miss engagement with the arms.

The present invention endeavors to abviate the difficulties of the prior art by dealing with the problem of inaccurate spacing of the conductors in the cable to make the conductors conform to the accurate positioning of the terminals in a housing member.

SUMMARY OF THE INVENTION

The present invention relates to a method and apparatus for terminating multi-conductor flat flexible cable by securing the cable in a clamping member which drives the conductors of the cable to accurately spaced locations. The clamped cable is then engaged by a connector block having a plurality of insulation displacing terminals extending therefrom in accurate, fixed spacing. The terminals enter the clamp and effect an insulation displacing engagement with the respective conductors contained therein. The clamp member includes a pair of hingedly attached plates having a plurality of conductor directing channels on the mating faces thereof. The alternate channels are preferably aligned along two parallel spaced planes so that the insulation between the individual conductors is caused to be stretched and deformed. The individual contacts mounted in the connector housing are preferably of the type described in the above-mentioned U.S. Pat. No. 3,820,055 and include a pair of legs defining an insulation displacing cavity therebetween and a latching tine outwardly directed from the free end of each of the legs. The opposite end of the contact is preferably profiled for mating with appropriate matable connectors.

It is accordingly an object of the present invention to provide a method and apparatus for terminating multi-conductor flat flexible cable by clamping the cable in such a manner as to assure accurate spacing of the conductors thereof prior to engagement with the terminals of the connector.

It is a further object of the present invention to teach a method and apparatus whereby the accurate spacing of terminals, heretofore enabled by the accurate molding of housing cavities, can be utilized by locally adjusting the normally inaccurate and wandering spacing of conductors in multi-conductor flat flexible cable so that accurate termination may be achieved.

It is a further object of the present invention to produce a multi-conductor flat flexible cable connector which can be readily and economically produced and which will assure accurate engagement of the conductors of a multi-conductor flat flexible cable with the terminals of a connector.

The means for accomplishing the foregoing objects and other advantages will become apparent to those skilled in the art from the following detailed description taken in reference to the accompanying drawings.

BRIEF DESCRIPTION OF THE PREFERRED EMBODIMENT

Figure 1:
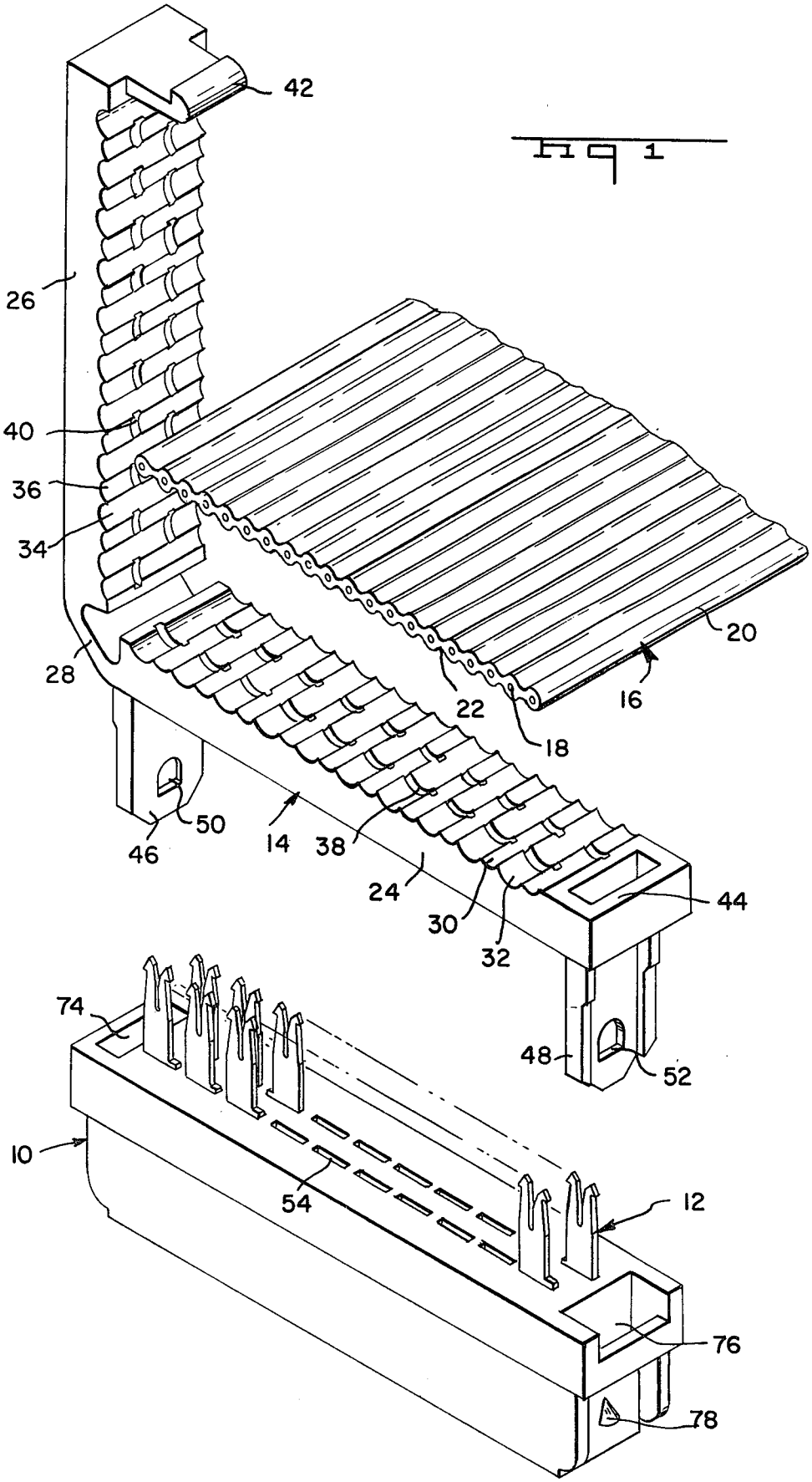
FIG. 1 is an exploded perspective view of the connector according to the present invention.

The subject connector assembly includes a connector housing 10, having a plurality of terminals 12 mounted therein, and a cable clamp 14 for engaging the multi-conductor flat flexible cable 16. The cable may be of any well known manufacture and include a plurality of conductors 18 held in substantially parallel, substantially fixed spaced relation by an insulation layer 20, which can be of any of the known materials. The webs 22 formed between the conductors should have at least a limited amount of resiliency which will allow for deformation of the cable.

The cable clamp 14 comprises a pair of rigid bottom and top clamping members 24, 26, respectively, held in unitary fashion by a flexible hinge member 28. The mating faces of the members 24, 26 include a plurality of conductor locating channels. Adjacent channels are located in two parallel spaced planes so that the recesses 30, 34 and 32, 36 define alternate annular conductor gripping passages extending transversely of the clamping member 14. Each passage is intersected by aligned transverse slots 38, 40, respectively, in the bottom and top members 24, 26. A first latching assembly 42, 44 is on the ends of the members 24, 26 opposite the hinge 28 and secures the members together in the closed position clamping the cable 16 therebetween. A second latching means extends normal from the ends of the bottom member 24 and comprises a pair of legs 46, 48 each having a detent receiving aperture 50, 52 therein.

The connector housing 10 includes a plurality of terminal receiving passages 54. The terminals 12 are mounted in the passages 54 with the body portion 56 of the terminal held in place by force fit or conventional latching means (not shown). The mating portion 58 of each terminal has a profile adapted to mate with further electrical connector terminals (not shown) while the conductor engaging end 60 extending from the connector block includes a pair of spaced arms 62, 64 defining an insulation displacing conductor engaging slot 66 therebetween. Outwardly directed latching projections 68, 70 are on the free end of the arms 62, 64, respectively, and engage shoulders 72 in the cable clamp. The housing also includes a latch passage 74, 76 at each end thereof to receive the latch legs 46, 48, respectively, and a pair of detents 78 for engaging in the respective apertures 50, 52 of the second latching means.

Figure 2:
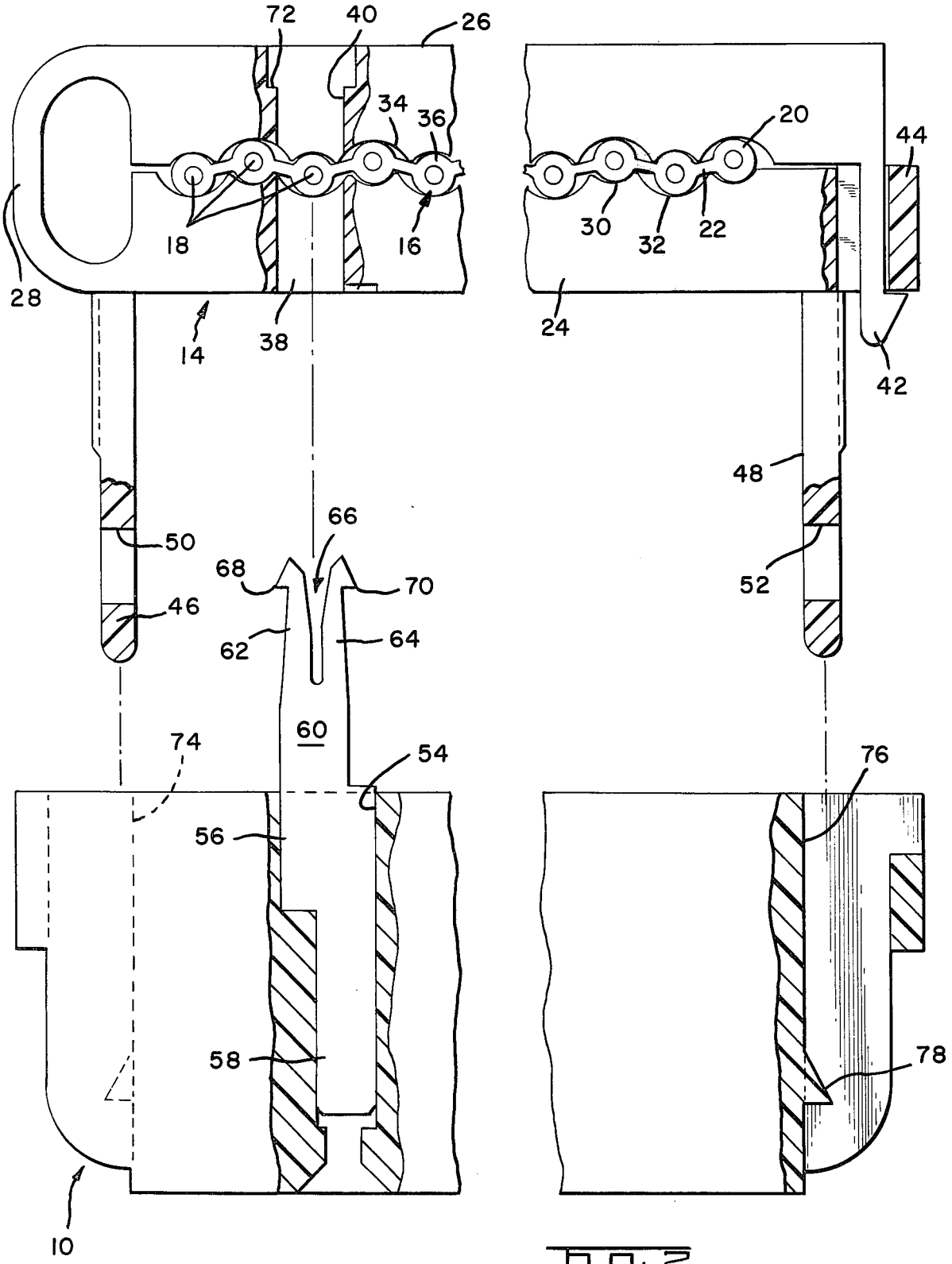
FIG. 2 is an exploded elevation, partially in section, of the subject connector in a partially assembled condition.
Figure 3:
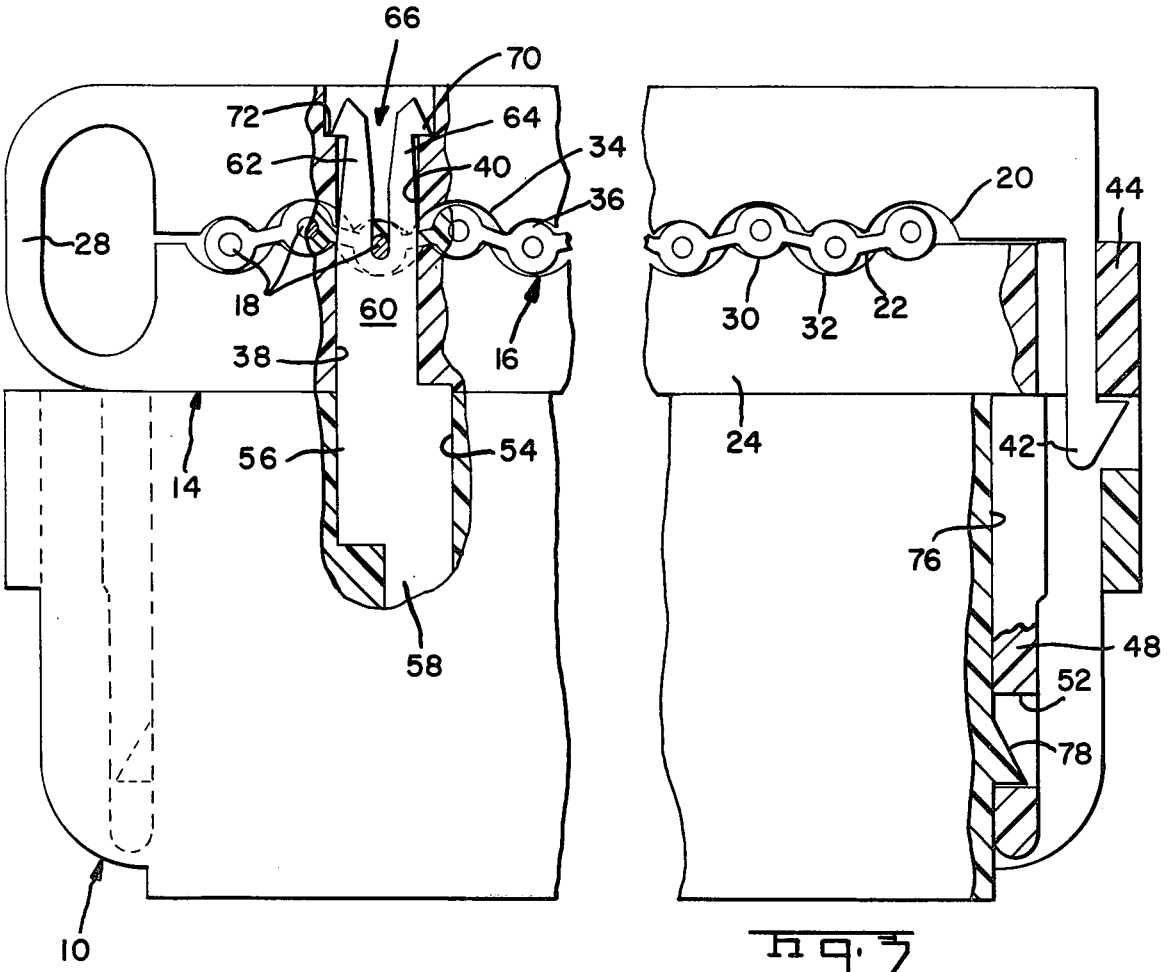
FIG. 3 is an elevation, similar to FIG. 2 and also partially in section, showing the fully terminated and engaged connector assembly according to the present invention.

In operation the cable is clamped in the clamping member so as to drive the conductors into their respective passages, as shown in FIG. 2. It will be noted that the conductors are held in the cable clamp so as to have alternate conductors lying in two parallel spaced planes thereby assuring the accurate positioning of the conductors. The latched clamping member and cable are then engaged with the connector housing, as shown in FIG. 3, with the terminals 12 effecting an insulation displacing engagement with the respective conductors. The cable clamp 14 is secured on the connector housing 10 both by engagement of the second latching means and latching projections of the terminals engaging in the cable clamp.

The present embodiment should be considered in all respects as being illustrative and not restrictive of the scope of the invention since the invention may be subject to many modifications and changes without departing from the spirit or essential characteristics thereof.

What is claimed is:

1. An electrical connector for electrically terminating conductors of multi-conductor flat flexible cable of the type having a plurality of conductors in side-by-side parallel spaced relationship within a web of plastic insulating material, said connector comprising:

a base member of insulating material having a plurality of cavities extending therethrough from one side thereof to another side which is opposite to said one side;

an electrical contact terminal mounted in each said cavity, each said contact terminal having a conductor receiving portion comprising a pair of spaced apart arms having opposite edges defining therebetween a conductor receiving slot, said arms extending normally beyond one side of said base member, and a mating portion directed towards said another side;

a cable clamping assembly comprising a pair of members hingedly attached at a first end and latching means at the opposite end, said clamping members having mating faces profiled to define therebetween a plurality of conductor aligning passageways, a like plurality of slots passing through both members of said assembly each intersecting a respective one of said passageways, and clamping means securing said cable clamping assembly on said base member, whereby upon positioning said cable in said cable clamping assembly and movement thereof towards said one side, said arms penetrate through said slots to engage in the conductors restrained in said passageways with the conductors being forced into the slot of a respective contact terminal to effect an insulation displacing engagement therebetween.

2. An electrical connector according to claim 1 wherein:

alternate ones of said passageways in said cable clamping assembly are displaced into two parallel spaced planes whereby the conductors of said cable are forced into accurate aligned positions.

3. An electrical connector according to claim 1 wherein:

said through slots of said cable clamping assembly are so dimensioned as to support and restrain deflection of said contact arms during penetration of and engagement with said cable.

4. An electrical connector according to claim 1 wherein:

each said contact further comprises interengageable means for retaining said cable clamping assembly on said base.

5. An electrical connector according to claim 4 wherein:

said interengageable means comprises laterally outwardly directed free end portions on said arms, said free end portions having shoulders directed towards said one side of said base member, said slots in said cable clamping assembly including surface portions which extend parallel to said one side of said base member and lie on the opposite side of said cable from said base member, said shoulders engaging said surfaces to secure said cable clamping assembly on said base member.

6. In combination:

an electrical connector and a cable clamping assembly;

said electrical connector comprising a housing member having opposite first and second side surfaces and a plurality of slots extending between said surfaces, a like plurality of contact terminals each mounted in a specific one of said slots, each said contact having a body, at least two tines extending from a first side of said body and defining an insulation displacing conductor engaging slot therebetween, a mating portion extending from another side of said body, said contact terminals being mounted in said housing member with at least said tines extending from said first surface;

said cable clamping assembly comprising first and second cable engaging members pivotally attached at a first end, latching means at a second end of said members adapted to hold them together in a cable clamping condition, mating faces of said members defining therebetween a plurality of conductor receiving passages, a like plurality of contact terminal passages each traversing a respective one of said conductor receiving passages and extending through said members; and interengageable means for retaining said cable clamping assembly on said electrical connector, whereby upon clamping of a multiple conductor flat flexible cable in said clamping assembly, the conductors thereof are driven to accurately aligned positions and movement of said assembly towards said connector causes said tines to penetrate said contact terminal passages to effect an insulation displacing engagement with respective conductors of said cable.

7. A method for accurately electrically terminating closely spaced conductors of multi-conductor flat flexible cable of the type having a plurality of conductors in side-by-side parallel spaced relationship within a web of plastic insulating material, said method comprising the steps of:

clamping the cable between a pair of members hingedly attached at a first end and latchingly secured at the opposite end and having mating faces profiled to define therebetween a plurality of accurately spaced conductor aligning passageways each intersected by a respective slot;

positioning said clamped cable in parallel spaced relation to one side of a base member having a plurality of contact terminals fixed therein, each with a conductor engaging portion comprising a pair of spaced apart arms having opposite edges defining therebetween a conductor receiving slot, said arms extending normally beyond said one side of said base member; and moving said clamped cable towards said one side whereby said arms penetrate through said slots to engage in the conductors restrained in said passageways with the conductors being forced into the slot of a respective contact terminal to effect an insulation displacing engagement therebetween.

* * * * *

UNITED STATES PATENT OFFICE

CERTIFICATE OF CORRECTION

Patent No. 4,068,912 Dated January 17, 1978

Inventor(s) William Jeffrey Hudson, Jr. et al.

It is certified that error appears in the above-identified patent and that said Letters Patent are hereby corrected as shown below:

On title page, item [75] where it has "Inventors:" "Bahermans" should read -- Bakermans -- .

Signed and Sealed this

Ninth Day of May 1978

[SEAL]

Attest:

RUTH C. MASON
Attesting Officer

LUTRELLE F. PARKER
Acting Commissioner of Patents and Trademarks